US007236601B1

(12) United States Patent
Bachmann et al.

(10) Patent No.: US 7,236,601 B1
(45) Date of Patent: Jun. 26, 2007

(54) PANEL LOUDSPEAKER

(76) Inventors: Wolfgang Bachmann, Kästnerstrasse 10, 41516 Grevenbroich (DE); Gerhard Krump, Rosengasse 18, 94374 Schwarzach (DE); Hans-Jürgen Regl, Leichtlgasse 8, 93049 Regensburg (DE); Andreas Ziganki, Leyer Str. 20, D-40822 Mettmann (DE)

( * ) Notice: Subject to any disclaimer, the term of this patent is extended or adjusted under 35 U.S.C. 154(b) by 735 days.

(21) Appl. No.: 09/700,139

(22) PCT Filed: May 14, 1999

(86) PCT No.: PCT/EP99/03312

§ 371 (c)(1),
(2), (4) Date: Dec. 15, 2000

(87) PCT Pub. No.: WO99/60818

PCT Pub. Date: Nov. 25, 1999

(30) Foreign Application Priority Data

May 15, 1998 (DE) ..... 198 21 855

(51) Int. Cl.
*H04R 25/00* (2006.01)

(52) U.S. Cl. ..... 381/152; 381/431

(58) Field of Classification Search ..... 381/152, 381/396, 414, 431, 425, 424, 423; 181/157, 181/161, 173, 199

See application file for complete search history.

(56) References Cited

U.S. PATENT DOCUMENTS

| | | | | |
|---|---|---|---|---|
| 3,247,925 | A | 4/1966 | Warnaka | |
| 4,252,211 | A | 2/1981 | Matsuda et al. | |
| 4,426,556 | A | 1/1984 | Saiki et al. | |
| 6,003,766 | A * | 12/1999 | Azima | 235/379 |
| 6,160,898 | A | 12/2000 | Bachmann et al. | |
| 6,170,603 | B1 | 1/2001 | Bachmann et al. | |
| 6,275,598 | B1 | 8/2001 | Bachmann et al. | |
| 6,347,149 | B1 * | 2/2002 | Bachmann | 381/396 |
| 6,369,943 | B1 | 4/2002 | Bachmann et al. | |
| 6,494,289 | B1 | 12/2002 | Bachmann et al. | |
| 2001/0017927 | A1 | 8/2001 | Bachmann et al. | |
| 2001/0055403 | A1 | 12/2001 | Bachmann et al. | |

FOREIGN PATENT DOCUMENTS

| | | |
|---|---|---|
| DE | 30 41 742 C2 | 11/1980 |
| DE | 29 32 942 C2 | 2/1981 |
| DE | 31 26 993 C2 | 7/1981 |
| EP | 0 296 139 | 12/1988 |
| EP | 0 924 960 | 6/1999 |
| WO | WO 97/09840 | 3/1997 |

* cited by examiner

*Primary Examiner*—Xu Mei
(74) *Attorney, Agent, or Firm*—Scott E. Kamholz; Foley Hoag LLP

(57) ABSTRACT

The invention relates to so-called panel loudspeakers (11) working according to the multiresonance principle. Said loudspeakers are generally formed by a core layer (13) and at least one outer layer (14.*o*, 14.*u*). The outer layers (14.*o*, 14.*u*) are connected to the core layer (13). A periphery is also provided (12) enclosing the panel loudspeaker (11) at a lateral distance (A). The panel loudspeaker is connected to the periphery (12) by means of connecting elements (17, 17'). Although good reproduction results can be obtained in the mid and high audio frequencies with the panel loudspeakers (11) described above, undesired large panel surfaces are known to be required for good low frequency reproduction. When such panel surfaces are not used, the lowest panel resonances ensuring bass reproduction are shifted towards the midfrequencies. Hence, the invention aims at providing a panel loudspeaker (11) exhibiting improved acoustic reproduction in the low frequency range despite a relatively smaller panel surface. According to the invention, this is achieved in that the connecting elements (17 17') are subjected to mechanical tension when they are connected to the periphery (12) resulting in supplementary particularly low frequency drum resonances in addition to the existing low frequency panel resonances, which can be modulated by the tension in the connecting elements (17, 17').

8 Claims, 3 Drawing Sheets

PANEL LOUDSPEAKER

FIELD OF THE INVENTION

The invention relates to panel loudspeakers and, more particularly, to improving the radiation characteristic of panel loudspeakers at low frequencies.

BACKGROUND OF THE INVENTION

Panel loudspeakers operating according to the multi-resonance principle are known in the art and frequently referred to as "distributed mode loudspeakers." These devices are essentially formed of a flat panel and at least one drive system, wherein oscillations are introduced in the panel by supplying low frequency electrical audio signals to the drive system. The drive systems for these devices are formed of one or several of electromagnetic drivers (shakers), depending on the application. However, the drive systems can also include piezo-electric bending oscillators, either alone or in combination with the aforedescribed shakers.

To properly operate panel loudspeakers, the loudspeakers are connected to a periphery using connecting elements. With this periphery, the entire panel loudspeaker can be secured from the outside and, on the other hand, the weight of the panel and of the drive system(s) can be supported in a manner advantageous for sound reproduction.

In sound reproduction systems implemented as panel loudspeakers, "bending wave radiation" can occur above a critical lower frequency limit, with the panel loudspeaker radiating the bending waves in a direction that depends on the sound frequency. A cross-section through a directional diagram shows a main lobe having a frequency dependent direction.

The panel of the panel loudspeaker consists of a sandwich structure, wherein preferably two opposing surfaces of a very light core layer are connected, for example by an adhesive bond, by way of a respective cover layer that is thin in comparison to the core layer. The panel loudspeaker has a particularly good sound reproduction if the material for the cover layer has a high dilatational wave velocity. Suitable material for cover layers are, for example, thin metal foils or fiber-reinforced plastic foils. The core layer also has to meet certain requirements and should have a particularly low density of, for example, 20 to 30 kg/m$^3$). The core layer should also be able to withstand high shearing forces acting normal to the cover layers, which requires that the elasticity module in the direction normal to the cover layers is sufficiently large, whereas a small elasticity module parallel to the cover layers is acceptable. Accordingly, the core layer can be either anisotropic or isotropic. Suitable ultra-light core layer structures are, for example, honeycomb structures made of light metal alloys or resin-impregnated fiber-reinforced paper (anisotropic) and expanded foam (isotropic).

A system of the aforedescribed type can radiate sound waves by connecting the panel to a drive system which deforms the panel perpendicular to the plane of the cover layers in a wave-like pattern. The drive system can be a conventional magnet system that is attached to or integrated with the panel.

The efficiency of panel loudspeakers operating according to the multi-resonance principle can be optimized by leaving the marginal edge of the panel, if all possible, "unrestrained." In other words, transverse oscillations propagating in the panel should be neither restricted nor attenuated in the marginal region of the panel.

Although the panel loudspeaker described above can successfully reproduce tones in the midrange and high-frequency range, it has been observed that low frequencies, i.e., bass tones, can only be faithfully reproduced by using panels having an undesirably large surface area. If the required large surface area is not provided, then the lowest panel frequencies which support the bass reproduction, move to the mid-frequency range.

It is a therefore an object of the invention to provide panel loudspeakers with relatively small panel surface areas that have an improved sound reproduction in the bass frequency range.

SUMMARY OF THE INVENTION

If a panel of a panel loudspeaker is connected with a periphery by way of connecting elements that are under mechanical tension, then additional resonances, in particular low frequency drum resonances, are produced in addition to the existing low frequency panel resonances. These additional resonances can be tuned by adjusting the tension in the connecting elements.

It should be pointed out at this point that the material used for the connecting elements and the pretension in the connecting elements has a significant impact on the reproduction of low-frequency audio signals.

It is not necessary that the tensioned connecting elements have the same a tension in different directions.

If the respective connecting elements are formed either by one cover layer or by both cover layers, with the respective cover layer(s) bridging the lateral gap to the periphery, then the periphery and the panel form a very simple unit that can be manufactured easily and inexpensively.

If the respective periphery is formed by a frame, then such assemblies can be easily connected with other objects, because the required tension in the cover layer(s) and/or the connecting elements can be produced with high quality already at the place of manufacture.

The panel loudspeakers according to the invention can not only be used as stand-alone sound reproduction units. Instead or in addition, several panel loudspeakers can also be combined into a larger acoustic wall, without the need to directly connect the individual panel with a periphery that is not excited by drivers. It has been observed in the context of the present invention that the same type of connecting elements that are employed to connect the panel to a periphery that is not excited (e.g., a frame), can also be used to connect adjacent panels of a larger acoustic wall with one another, without acoustically coupling these panels. If such larger acoustic wall is also connected, for example, with a frame through corresponding connecting elements, then the tension that exists in the connecting elements attached to the frame can also be used to adjust the tension in the connecting elements that are disposed between the panels of the acoustic wall. The tension in the connection between two adjacent decoupled panels can then be fine-tuned by selecting a proper size and/or material for the respective connecting element.

The tension in the cover layers and/or connecting elements can be easily adjusted by providing tensioning strips on the edges of the corresponding connecting elements that are connected with the periphery. The tension can further be adjusted by providing the periphery with edges which are in contact with the tensioning strips when the panel is connected to the periphery, and by making the distance between the tensioning strips and the coordinate lines extending through the center of the respective panel loudspeaker smaller than the distance between the edges and the coordinate lines that also extend through the center of the periphery, before the panel is connected to the periphery. By connecting the tensioning strips with the edges, a uniform tension defined by the respective distances can be easily attained in the cover layers and the connecting elements of the respective panel loudspeaker.

The connecting elements under tension provide particularly advantageous sound reproduction conditions with a panel loudspeaker formed in this manner and used for reproducing low-frequency audio signals. However, the application of pretensioned connecting elements is not limited to improving only the bass reproduction. Cover layers and/or connecting elements under tension can also be employed with midrange and broadband panels.

If the regions of the cover layers that are connected with the core layer are under mechanical tension, then the dilatational wave velocity of the cover layers is increased, in particular when using thin metal foils.

The oscillation amplitude of the very low-frequency resonances produced by the mechanical tension of the connecting elements and/or the cover layers can be reduced by providing those elements that are subject to mechanical tension (cover layers and/or connecting elements) with attenuation (damping) elements to provide damping.

The mechanical tension in the connecting elements and the cover layers can be different. In this way, different attenuation values can be easily realized for the different elements.

DETAILED DESCRIPTION OF CERTAIN ILLUSTRATED EMBODIMENTS

Figure 1:
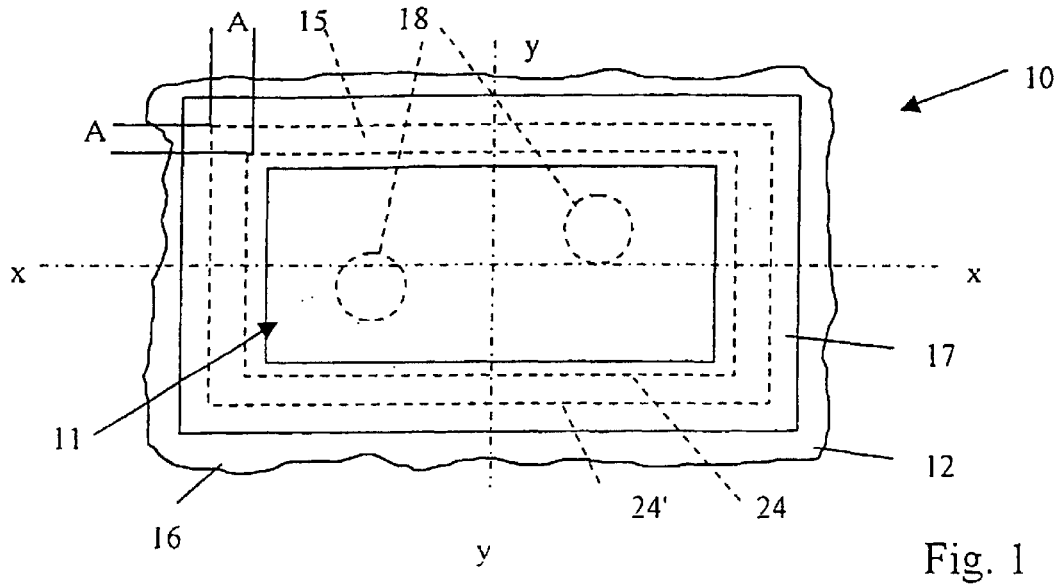
FIG. 1 shows a top view of a panel loudspeaker.

The invention will now be described in detail with reference to the Figures. FIG. 1 shows a sound reproduction device 10 in form of a panel loudspeaker operating according to the aforedescribed "bending wave principle." The sound reproduction device 10 is formed by a panel 11 and a periphery 12.

Figure 3:
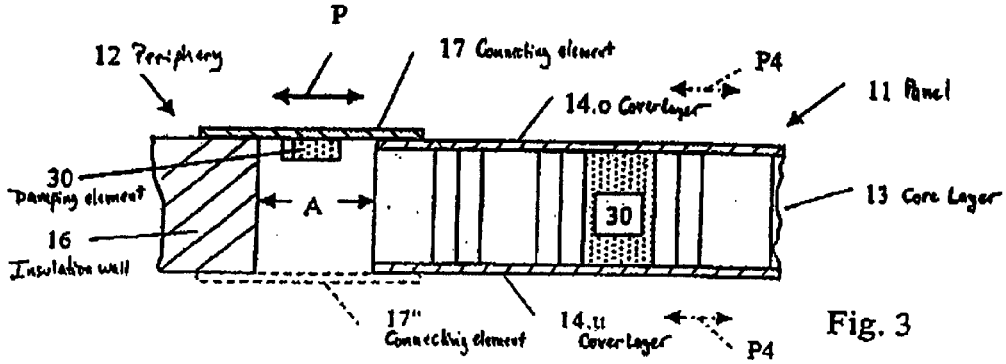
FIG. 3 is a side view of the panel loudspeaker of FIG. 1.

As seen in more detail in FIG. 3, the panel 11 is constructed as a sandwich structure which includes a core layer 13, which in the present example has a honeycomb structure, and thin cover layers 14.*o*, 14.*u* disposed on two opposing surfaces of the core layer 13.

In the embodiment depicted in FIG. 1, the periphery 12 is formed by an installation wall with an opening 15. The panel 11 is inserted into this opening. The connection between the panel 11 and the periphery 12 formed by the installation wall 16 is implemented by connecting a connecting element 17 with the cover layers 14.*o* and the installation wall 16. As seen from FIG. 1, which depicts a top view of a panel loudspeaker 10, the connecting element 17 is formed as a single piece and completely covers the gap A formed between the opposing edges 24 and 24' of the panel 11 and the respective opening 15.

Excellent sound reproduction is achieved by placing the cover layers 14.*o*, 14.*u* of the panel 11 under mechanical tension. The tension in the connecting elements 17 which is indicated in FIG. 3 by the double arrow P, is achieved in the embodiment illustrated in FIG. 1 by stretching the regions of the connecting element 17 that are in contact with the installation wall 16, in the x- and y-direction (FIG. 1) after the panel 11 is inserted in the opening 15, but before these regions are connected with the installation wall 16.

For sake of completeness, it should be mentioned with reference to FIGS. 1 and 3, that the reference numeral 18 in FIG. 1 indicates drivers that introduce oscillations in the panel 11, and that the connecting element 17" indicated in FIG. 3 by the dashed line can provide another connection—which is also under tension—between the installation wall 16 and the panel 11.

As indicated in FIG. 3 by the dotted double arrows P4, the cover layers 14.*u*, 14.*o* that are connected with the core layer 13 can also be under mechanical tension. However, the degree of the mechanical tension of the connecting elements 17 and the cover layers 14.*u*, 14.*o* need in this case not be identical. The reference numerals 30 in FIG. 3 indicate optional damping element s for limiting the oscillation amplitude when the connecting elements 17,17' and/or the cover layers 14.*o*, 14.*u* are under mechanical tension.

Figure 2:
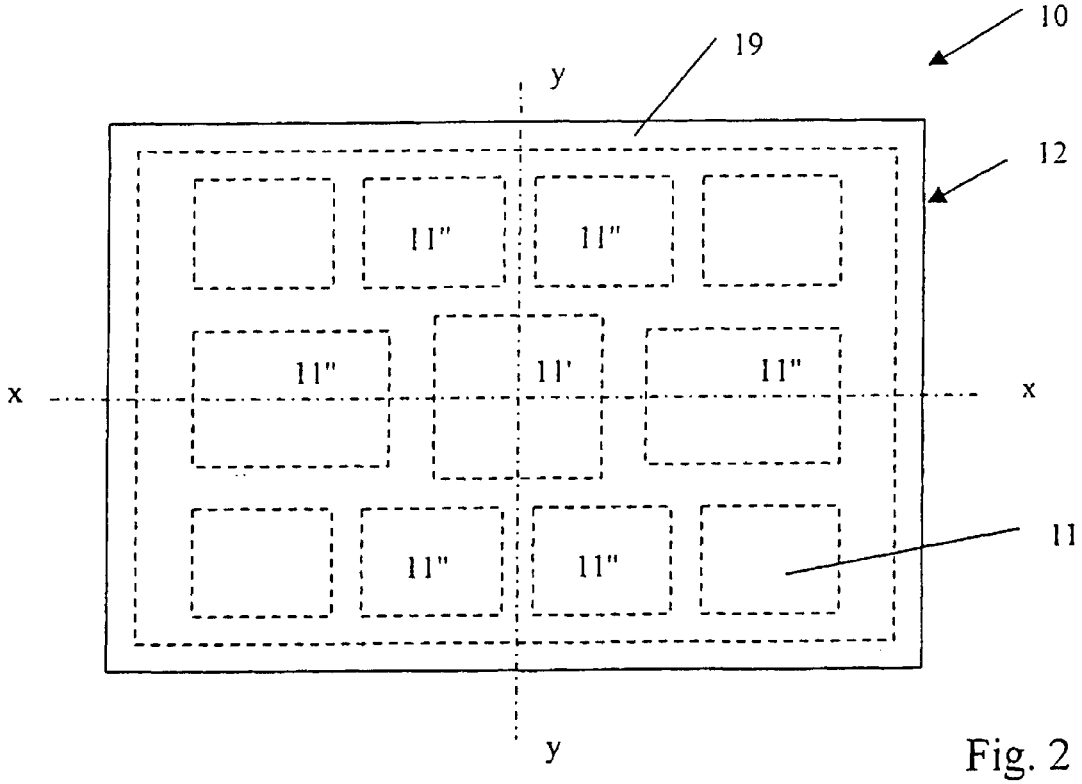
FIG. 2 shows a top view of another panel loudspeaker.

FIG. 2 shows a panel loudspeaker 10 consisting of several panels 11. The panels 11" surrounding the panel 11' form the periphery of the panel 11' with respect to the center panel 11'. In the illustrated embodiment, a separate frame that surrounds all panels 11 forms the periphery 12 for all panels. Using a separate frame 19 with one or several panels 11 has the advantage that the connecting elements 17 do not have to be tensioned when the panel(s) is/are connected at the installation location, but that the tension in the connecting elements 17 can be adjusted easily and exactly already at the factory, if the respective panel loudspeaker(s) is/are shipped installed in a frame 19.

As also seen from the top view of FIG. 2, the panels 11 can have different dimensions as well as a different spacing from one another and/or from the frame 19. The panels 11 have different dimensions because the different panels 11 of the device illustrated in FIG. 2 are so-called range radiators optimized for different audio frequency ranges. For decoupling the different panels 11 from each other, the spacing between the individual panels 11 and/or the spacing between the panels 11 and the frame 19 is also adapted to the respective reproduction range of these panels 11. Since the panels 11 are optimized for different frequency ranges, the mechanical tension in the cover layers (not shown in detail in FIG. 2) of the different panels 11 can also be adapted to the different reproduction requirements.

In the embodiment depicted in FIG. 2, separate connecting elements 17 are no longer required. Instead, the panels 11 are connected with each other and/or with the frame 19 only through the cover layer 14.*o*. This type of connection is shown in detail in FIGS. 4*b* and 5*b* and will be discussed below more specifically with reference to these Figures.

Figure 4A:
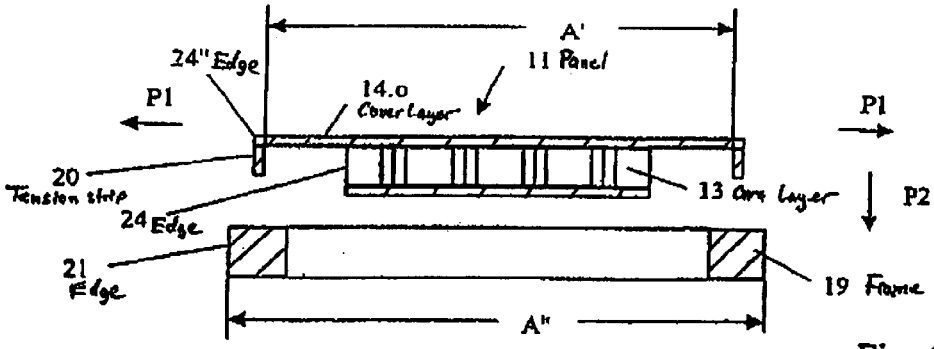
FIGS. 4*a, b* show another side view of a panel loudspeaker.
Figure 4B:
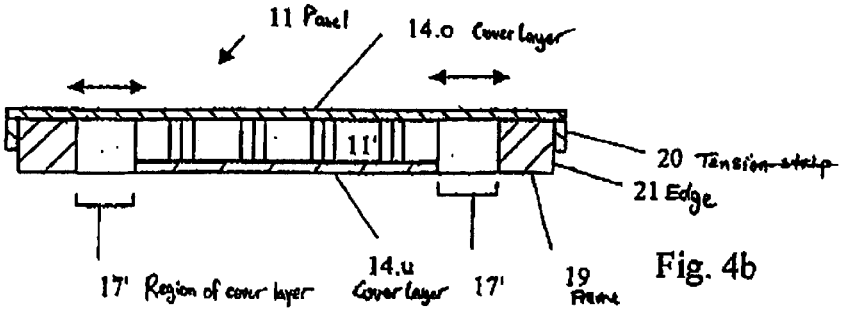

FIG. 4*a* depicts an embodiment of a frame 19. A panel 11 is arranged above the frame 19. Unlike the panel 11 shown in FIG. 3, the cover layer projects slightly over the marginal edges 24 of the core layer 13. In addition, tension strips 20 are attached to the marginal edges 24" of the cover layer 14.*o*. If the cover layer 14.*o* is elastically deformed by an external force in the direction of the arrow P1 and is in this state lowered towards the frame 19 in the direction P2, then the situation shown in FIG. 4*b* will arise where the cover layer 14.*o* contacts the frame. As also seen in FIG. 4*b*, the panel 11 is connected to the frame 19 only through the cover layer 14.*o* and the tension strips 20 contact the lateral edges 21 of the frame at the end of the aforedescribed movement in the direction of the arrow P2. Since according to the situation illustrated in FIG. 4*a*, the separation A' between the two tension strips 20 before installation is smaller than the separation A" between two opposing marginal edges 21 of the frame 19, the desired mechanical tension (as indicated by the double arrows) builds up in the situation depicted in FIG. 4*b* as a result of the restoring forces produced in the regions 17' of the cover layer 14.*o*.

If, unlike the illustration of FIGS. 4*a* and 4*b*, the cover layer 14.*o* is not connected with the core layer 13, then tension builds up in the entire cover layer 14.*o*. To maintain the advantageous effects of the tension cover layer 14.*o* for sound transmission, the core layer 13 will have to be connected with the cover layer 14.*o*.

Figures 5A, 5B:
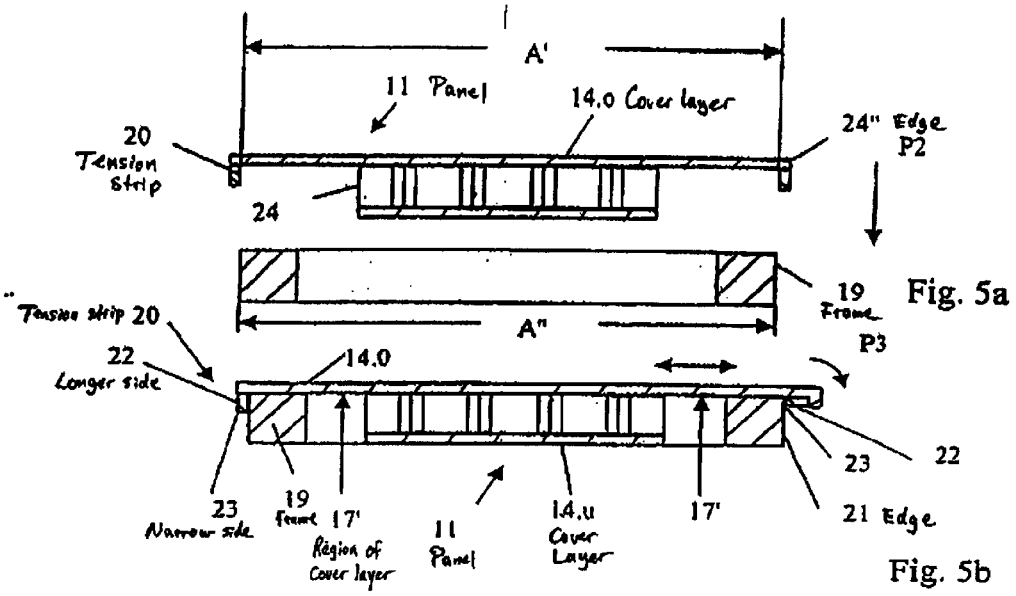
FIGS. 5*a, b* show another side view of a panel loudspeaker.

FIGS. 5*a* and 5*b* depict another embodiment of a connection under mechanical tension between a panel 11 and a frame 19 after installation. Unlike the embodiment depicted in FIGS. 4*a* and 4*b*, the spacing A' between the tension strips 20 is identical to the spacing A" between the opposing marginal edges 21 of the frame 19. With these values for the respective spacing, the cover layer 14.*o* depicted in FIG. 5*a* need not be exposed to a force (P1) (shown in FIG. 4*a*) in order to establish a connection with a frame 19 (FIG. 5*b*). The required tension in the regions 17' of the cover layer 14.*o* is produced by first establishing contact between the cover layer 14.*o* and the frame 19 as well as between the tension strips 20 and the marginal edges 21 without tension (a shown on the left side in FIG. 5*b*), and by subsequently rotating one or both tension strips 20 in the direction of arrow P3. As a result, the narrow side 23 of the tension strips 20—instead of the longer side 22—makes contact with the marginal edge 21 of the frame 19 (a shown on the right side in FIG. 5*b*).

If tension is to be introduced not only in the regions 17' of the cover layer 14.*o*, but rather across the entire cover layer 14.*o*, then the cover layer 14.*o* should be connected to the frame 19 following the discussion above with reference to FIGS. 4*a* to 5*b*, whereafter the core layer 13 is attached to the fully tensioned cover layer 14.*o*, for example, with an adhesive. If the entire cover layer 14.*o* is under tension, then the core layer 13 and the cover layer 14.*o* need not be connected in a subsequent separate operation as long as the unit composed of the core layer 13 and the cover layer 14.*o* is connected according to FIGS. 4*a* to 5*b* and the adhesive connecting the cover layer 14.*o* with the core layer 13 has not yet set.

For sake of completeness, it should be noted that the embodiments depicted in FIGS. 4*a* to 5*b* can be modified so as to place both cover layers 14.*o* and 14.*u* under mechanical tension.

What is claimed is:

1. Panel loudspeaker comprising at least one sound radiating panel having a core layer and at least one cover layer connected with the core layer, a periphery that surrounds the at least one sound radiating panel with a lateral gap, and at least one connecting element that connects the at least one sound radiating panel with the periphery, wherein the at least one connecting element is under mechanical tension when connected with the periphery, and wherein regions of the at least one cover layer that are connected with the core layer are also under mechanical tension.

2. Panel loudspeaker according to claim 1, wherein the at least one connecting element is formed by the at least one cover layer of respective sound radiating panel in that at least one of the cover layers of the respective sound radiating panel extends to the periphery.

3. Panel loudspeaker according to claim 1, characterized in, wherein the periphery is formed by a frame.

4. Panel loudspeaker according to claim 1, wherein the periphery is formed by at least one additional panel.

5. Panel loudspeaker according to claim 1, wherein the at least one connecting element is provided with a tension strip disposed on a marginal edge of the at least one sound radiating panel that is connected with the periphery, wherein the periphery has edges that are contacted by the tension strip when the at least one sound radiating panel is connected with the periphery, and wherein for a sound radiating panel that has not yet been connected with the periphery, distances between a respective tension strip and coordinate lines extending through a center of a respective sound radiating panel are smaller than distances between the edges and coordinate lines that also extend through a center of the periphery.

6. Panel loudspeaker according to claim 1, wherein the sound radiating panel is a bass panel adapted to reproduce low-frequency sound.

7. Panel loudspeaker according to claim 1, wherein at least one of the core layer and the at least one connecting element is provided with a damping element.

8. Panel loudspeaker according to claim 7, wherein a mechanical tension in the at least one connecting is different from the mechanical tension in the at least one tensioned cover layer.

* * * * *

UNITED STATES PATENT AND TRADEMARK OFFICE

CERTIFICATE OF CORRECTION

PATENT NO. : 7,236,601 B1
APPLICATION NO. : 09/700139
DATED : June 26, 2007
INVENTOR(S) : Wolfgang Bachmann et al.

It is certified that error appears in the above-identified patent and that said Letters Patent is hereby corrected as shown below:

Column 2,
Line 30, delete the word "a".

Column 6,
Claim 3, lines 23 and 24, delete "characterized in,".
Claim 8, line 53, insert --element-- after "connecting".

Signed and Sealed this

Fourteenth Day of August, 2007

JON W. DUDAS
*Director of the United States Patent and Trademark Office*